US006145761A

United States Patent [19]

Müller et al.

[11] Patent Number: 6,145,761

[45] Date of Patent: Nov. 14, 2000

[54] FUEL INJECTION VALVE

[75] Inventors: Martin Müller, Möglingen; Stefan Herold, Bamberg; Jochen Riefenstahl; Reinhold Brückner, both of Litzendorf; Dirk Fischbach, Bamberg; Andreas Eichendorf, Schorndorf; Martin Bühner, Backnang; Rainer Norgauer, Ludwigsburg; Jürgen Virnekäs, Breitbrunn; Peter Schramm, Knetzgau; Hans Weidler, Pettstadt; Christian Preussner, Markgröningen; Thomas Keil, Bamberg; Oliver Kirsten, Kulmbach; Ottmar Martin, Eberdingen; Wolfgang Leuschner, Eggolsheim, all of Germany

[73] Assignee: Robert Bosch GmbH, Stuttgart, Germany

[21] Appl. No.: 09/284,309

[22] PCT Filed: Jul. 28, 1998

[86] PCT No.: PCT/DE98/02135

§ 371 Date: Sep. 20, 1999

§ 102(e) Date: Sep. 20, 1999

[87] PCT Pub. No.: WO99/10649

PCT Pub. Date: Mar. 4, 1999

[30] Foreign Application Priority Data

Aug. 22, 1997 [DE] Germany ..... 197 36 682

[51] Int. Cl.[7] ..... F02M 61/00

[52] U.S. Cl. ..... 239/533.12; 239/463; 239/494; 239/585.1; 239/585.4

[58] Field of Search ..... 239/463, 472, 239/473, 494, 496, 497, 533.2, 533.11, 533.12, 585.1, 585.4, 585.5

[56] References Cited

U.S. PATENT DOCUMENTS

| | | | |
|---|---|---|---|
| 3,464,630 | 9/1969 | Bendixen | 239/497 X |
| 4,040,396 | 8/1977 | Hitoshi . | |
| 4,971,254 | 11/1990 | Daly et al. | 239/533.12 X |
| 5,108,037 | 4/1992 | Okamoto et al. | 239/473 |
| 5,570,841 | 11/1996 | Nally, Jr. et al. . | |
| 5,642,862 | 7/1997 | Wakeman et al. . | |
| 5,730,367 | 3/1998 | Pace et al. | 239/585.4 X |
| 5,871,157 | 2/1999 | Fukutomi et al. | 239/533.12 X |
| 5,875,972 | 3/1999 | Ren et al. | 239/585.4 X |
| 5,979,801 | 11/1999 | Munezane et al. | 239/533.12 |

FOREIGN PATENT DOCUMENTS

| | | |
|---|---|---|
| 0 350 885 | 1/1990 | European Pat. Off. . |
| 39 43 005 | 7/1990 | Germany . |
| 56-075955 | 6/1981 | Japan . |
| 4-252861 | 1/1993 | Japan . |
| WO/98 35159 | 8/1998 | WIPO . |

*Primary Examiner*—Andres Kashnikow
*Assistant Examiner*—Steven J. Ganey
*Attorney, Agent, or Firm*—Kenyon & Kenyon

[57] ABSTRACT

A fuel injection valve, in particular, a high-pressure injection valve, for injecting fuel directly into a combustion chamber of a compressed-mixture internal combustion engine with externally supplied ignition. The fuel injection valve includes a guide and seating area formed by three disc-shaped elements provided at the downstream end of the valve. A swirl element is embedded between a guide element and a valve seat element. The guide element is used to guide a valve needle which passes through it and can move in the axial direction, while a valve closing segment of the valve needle interacts with a valve seat surface of the valve seat element. The swirl element has an inner opening area with multiple swirl channels which are not joined to the outer circumference of the swirl element. The entire opening area extends completely across the axial thickness of the swirl element.

15 Claims, 7 Drawing Sheets

FUEL INJECTION VALVE

BACKGROUND INFORMATION

The present invention relates to a fuel injection valve.

An electromagnetically operated fuel injection valve having multiple disc-shaped elements arranged in its seating area is already known from German Published Patent Application No. 39 43 005. Upon excitation of the magnetic circuit, a flat valve plate acting as a flat armature lifts up from a valve seat plate situated opposite and interacting with the valve plate, together forming a plate valve part. A swirl element, which sets the fuel flowing to the valve seat in a circular rotary motion, is located upstream from the valve seat plate. A stop plate limits the axial displacement of the valve plate on the side opposite the valve seat plate. The swirl element surrounds the valve plate, leaving a large amount of clearance; the swirl element thus guides the valve plate to a certain degree. On the lower end side of the swirl element several tangential grooves are provided which begin at the outer edge and extend all the way to a central swirl chamber. When the lower end face of the swirl element lies against the valve seat plate, the grooves become swirl channels.

In addition, a fuel injection valve is known from European Published Patent Application No. 0 350 885, in which a valve seat body is provided, with a valve closing member located on an axially movable valve needle interacting with a valve seat surface of the valve seat body. A swirl element which sets the fuel flowing to the valve seat in a circular rotary motion is located upstream from the valve seat surface in a recess in the valve seat body. A stop plate limits the axial displacement of the valve needle, with the stop plate having a central opening which serves to guide the valve needle to a certain extent. The opening in the stop plate surrounds the valve needle with a large amount of clearance, because the fuel to be supplied to the valve seat must also pass through this opening. On the lower end face of the swirl element several tangential grooves are provided which begin at the outer edge and extend all the way to a central swirl chamber. When the lower end face of the swirl element lies against the valve seat plate, the grooves become swirl channels.

SUMMARY OF THE INVENTION

The fuel injection valve according to the present invention has the advantage that it can be produced particularly easily and economically. The disc-shaped swirl element has a very simple structure, making it easy to mold. The only function performed by the swirl element is to produce a swirling or rotary motion in the fuel, thus preventing the formation of turbulence in the fluid, which may produce disturbances. All other valve functions are performed by other valve components. The swirl element can thus be machined to the best advantage. Because the swirl element is a single component, there are no limits to how it can be handled during the production process. Compared to swirl elements that have grooves or other swirl-producing depressions on one end face, an inner opening area which extends across the entire axial thickness of the swirl element and is surrounded by an outer circumferential rim area can be produced with simple means in the swirl element according to the present invention. Grooves, ducts, notches, flutes, and channels, which are otherwise complicated to produce, can thus be advantageously eliminated in the swirl element.

Like the swirl element and the valve seat element, the guide element is also easy to produce. In an especially advantageous manner, the guide element is used only to guide the valve needle projecting through a guide opening. The guide element functions are therefore clearly separate from those of the two other downstream elements.

The modular structure and the separation of functions associated therewith have the advantage that the individual components can be designed with a great deal of flexibility, making it possible to vary different spray parameters (spray angle, static spray volume) simply by changing one element.

The swirl channels can be advantageously extended by providing them with a curved or bent structure. The hook-shaped, bent ends of the swirl channels act as collecting pockets which form a large reservoir, allowing the fuel to flow with little turbulence. After the flow has been diverted, the fuel enters the actual tangential swirl channels slowly and without much turbulence, making it possible to produce a largely disturbance-free swirling motion.

By making minor structural changes, it is possible either to press the guide element against the swirl element with a compression spring or allow the end face of the guide element facing away from the swirl element to rest against a step of the valve seat carrier. In either case, the guide element or one guide segment of a valve seat carrier largely covers the swirl channels in the swirl clement with its lower end face, while the upper end face of the valve seat element limits the swirl channels on the opposite side.

DETAILED DESCRIPTION

Figure 1:
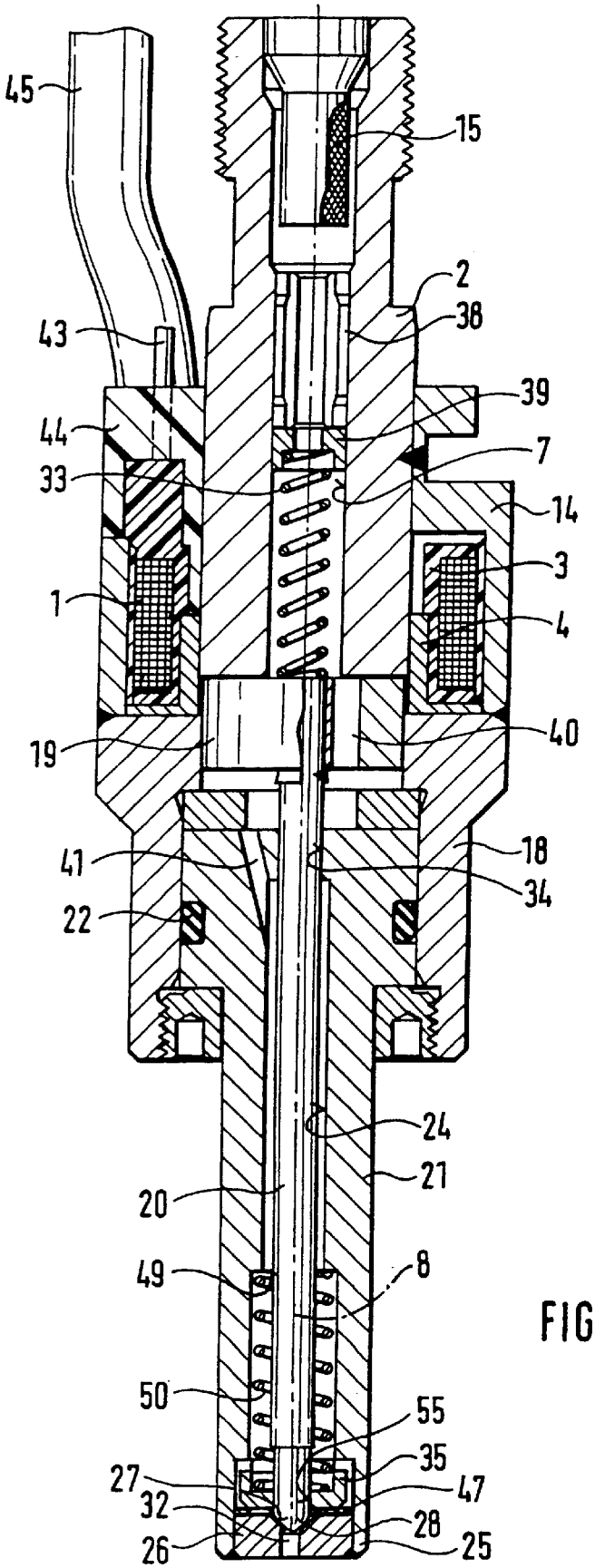
FIG. 1 shows a first embodiment of a fuel injection valve according to the present invention.

The electromagnetically operated valve illustrated, for example, as one embodiment in FIG. 1 in the form of an injection valve for fuel injection systems in compressed-mixture internal combustion engines with externally supplied ignition has a tubular, largely hollow cylindrical core 2 serving as the inner pole of a magnetic circuit and at least partially surrounded by a magnet coil 1. The fuel injection valve is suitable, in particular, for use as a high-pressure injection valve for injecting fuel directly into a combustion chamber of an internal combustion engine. A plastic bobbin 3 that has a stepped design, for example, holds one winding of magnet coil 1 and, in connection with core 2 and a non-magnetic annular intermediate section 4, which has an L-shaped cross-section and is partially surrounded by magnet coil 1, allows the injection valve to have an especially compact and short design in the region of magnet coil 1.

A longitudinal opening 7 stretching along a longitudinal valve axis 8 is provided in core 2. Core 2 of the magnetic circuit also acts as a fuel intake nozzle, with longitudinal opening 7 representing a fuel intake channel. Permanently attached to core 2 above magnet coil 1 is an outer metallic (e.g., ferritic) housing section 14, which closes the magnetic circuit in the form of an outer pole or outer conductive element and completely surrounds magnet coil 1, at least in the circumferential direction. A fuel filter 15, which filters out fuel components that are large enough to block or damage the injection valve, is provided at the intake end of longitudinal opening 7 of core 2. Fuel filter 15 is secured in place in core 2, for example, by pressing it into the latter.

Together with housing section 14, core 2 forms the intake end of the fuel injection valve, with upper housing section 14 extending just beyond magnet coil 1, e.g., in an axial direction, as viewed in the direction of flow. A lower tubular housing section 18, which surrounds or holds, for example, an axially moving valve part that includes an armature 19 and a rod-shaped valve needle 20 or a longitudinal valve seat carrier 21, is permanently attached to upper housing section 14, forming a seal. Both housing sections 14 and 18 are permanently joined together, for example, by a circumferential welded seam.

In the embodiment shown in FIG. 1, lower housing section 18 and largely tubular valve seat carrier 21 are screwed together permanently; they can also be joined by soldering or flanging. The joint between housing section 18 and valve seat carrier 21 is scaled, for example, by a gasket 22. Along its entire axial width, valve seat carrier 21 has an inner passage 24, which is positioned concentrically to longitudinal valve axis 8.

With its lower end 25, which also forms the downstream end of the entire fuel injection valve, valve seat carrier 21 surrounds a disc-shaped valve seat element 26 that is fitted into passage 24 and has valve seat surface 27 which is tapered conically in the downstream direction. Rod-shaped valve needle 20, which has for example a largely circular cross-section and a valve closing segment 28 at its downstream end, is positioned in passage 24. This, for example, spheroidally or partially spherically or, as shown in all figures, conically tapered valve closing segment 28 interacts in the known manner with valve seat surface 27 provided in valve seat element 26. Downstream from valve seat surface 27, at least one discharge opening 32 for the fuel is provided in valve seat element 26.

The injection valve is operated electromagnetically in the known manner. An electromagnetic circuit, containing magnet coil 1, core 2, housing sections 14 and 18, and armature 19, is used to move valve needle 20 in the axial direction, thus opening the injection valve against the force of a restoring spring 33 located in longitudinal opening 7 of core 2, or closing it. Armature 19 is connected to the end of valve needle 20 facing away from valve closing segment 28, for example by a welded seam, and aligned with core 2. A guide opening 34 provided in valve seat carrier 21 at the end facing armature 19 and a disc-shaped guide element 35 having a dimensionally accurate guide opening 55 located upstream from valve seat element 26 are used to guide valve needle 20 while moving in an axial direction along longitudinal valve axis 8 together with armature 19. During its axial movement, armature 19 is surrounded by intermediate section 4.

An adjusting sleeve 38 which is pushed, pressed, or screwed into longitudinal opening 7 of core 2 is used to adjust the pre-tension of restoring spring 33, whose upstream end rests against adjusting sleeve 38 and whose opposite end is supported on armature 19, using a centering piece 39. Provided in armature 19 are one or more bore-like flow channels 40 through which the fuel can reach passage 24 from longitudinal opening 7 in core 2 via connecting channels 41 provided downstream from flow channels 40 and close to guide opening 34 in valve seat carrier 21.

The lift of valve needle 20 is defined by the position in which valve seat element 26 is mounted. When magnet coil 1 is not excited, one end position of valve needle 20 is established when valve closing segment 28 comes to rest against valve seat surface 27 of valve seat element 26, while the other end position of valve needle 20 is established when armature 19 comes to rest against the downstream end face of core 2 when magnet coil 1 is excited. The surfaces of the components in the latter stop area are, for example, chromium-plated.

Magnet coil 1 is electrically contacted, and thus excited, by contact elements 43 which are provided with a plastic extrusion layer 44 outside bobbin 3. Plastic extrusion layer 44 can also cover additional components of the fuel injection valve (such as housing sections 14 and 18). An electrical connecting cable 45, used to power magnet coil 1, runs out from plastic extrusion layer 44. Plastic extrusion layer 44 extends through upper housing section 14, which is interrupted in this region.

Figure 2:
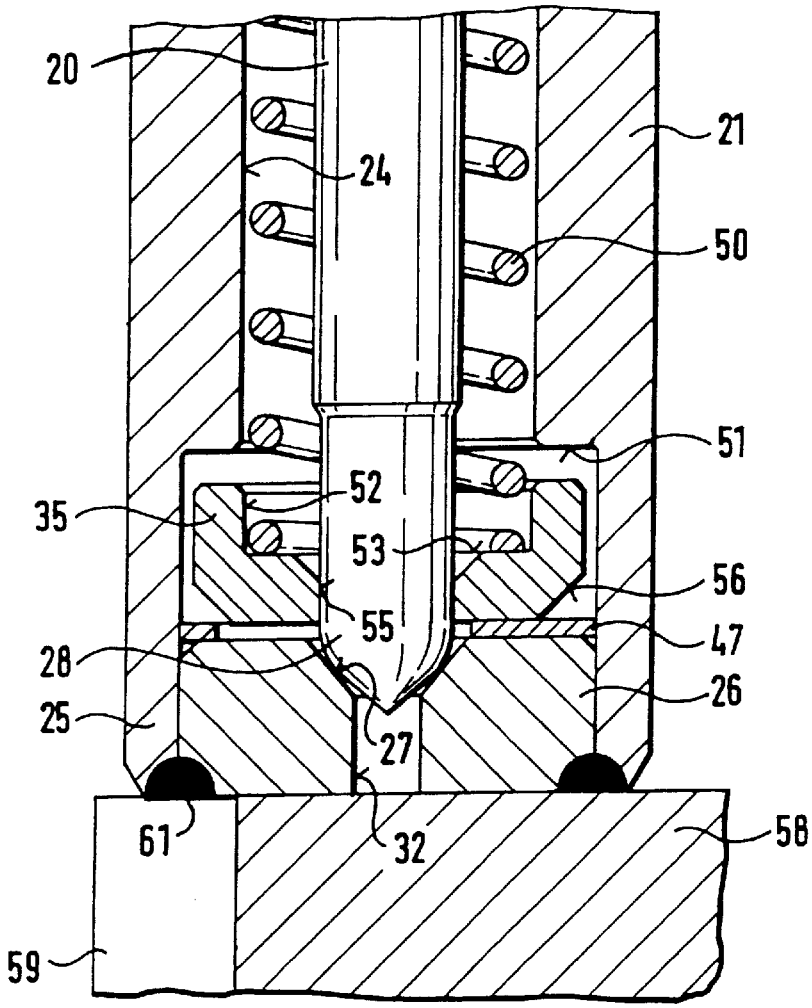
FIG. 2 shows an enlarged view of a first guide and seating area extracted from FIG. 1.

FIG. 2 shows the guide and seating area as a detail of FIG. 1 on a different scale in order to more clearly illustrate this valve area designed according to the present invention. The guide and seating area provided in passage 24 at injection end 25 of valve seat carrier 21 is illustrated in FIG. 2 and generally formed by three disc-shaped, functionally separate elements arranged consecutively in an axial direction in all other subsequent embodiments according to the present invention. Guide element 35, a very flat swirl element 47, and valve seat element 26 are positioned consecutively in the downstream direction.

Downstream from guide opening 34, passage 24 of valve seat carrier 21 is designed, for example, with two steps, with the diameter of passage 24 increasing with each step when viewed in a downstream direction. A first shoulder 49 (FIG. 1) is used as a contact surface, e.g., for a helical compression spring 50. Second step 51 provides an enlarged mounting space for three elements 35, 47, and 26. Swirl element 47 has an outer diameter which allows it to be fitted tightly into passage 24 of valve seat carrier 21, leaving little clearance. Compression spring 50 surrounding valve needle 20 holds three elements 35, 47, and 26 gently in place in valve seat carrier 21, since the sides of these elements opposite shoulder 49 press against guide element 35. To provide a secure contact surface for compression spring 50 on guide element 35, the end face oriented away from swirl element 47 is provided with a recess 52, with compression spring 50 resting against its bottom 53.

Guide element 35 has a dimensionally accurate guide opening 55 through which valve needle 20 moves during its axial motion. The outer diameter of guide element 35 is smaller than the diameter of passage 24 downstream from step 51. This guarantees that fuel will flow in the direction of valve seat surface 27 along the outer circumference of guide element 35. Downstream from guide element 35, the fuel flows directly into swirl element 47, which is viewed from the top in FIG. 3. To provide better flow close to the outer rim of swirl element 47, guide element 35 is provided, for example, with a circumferential chamfer 56 on its lower end face.

The three elements 35, 47, and 26 lie directly one on top of the other with their end faces touching. Before valve seat element 26 can be permanently mounted onto valve seat carrier 21, valve seat element 26 must be aligned. Valve seat element 26 is aligned with the longitudinal axis of valve seat carrier 21 using a tool, e.g., in the form of a punch 58, which is indicated only schematically in FIG. 2 and which rests against the outer downstream end face of valve seat element 26 and valve seat carrier 21. This welding alignment punch 58 has a number of cut-outs 59, distributed for example over its circumference, through which valve seat element 26 is spot laser-welded to valve seat carrier 21. Upon removing punch 58, valve seat element 26 can be completely welded circumferentially with a sealing welded seam 61. Subsequently, guide element 35, for example, is re-aligned with valve seat element 26 using valve needle 20 resting on valve seat surface 27.

Figure 3:
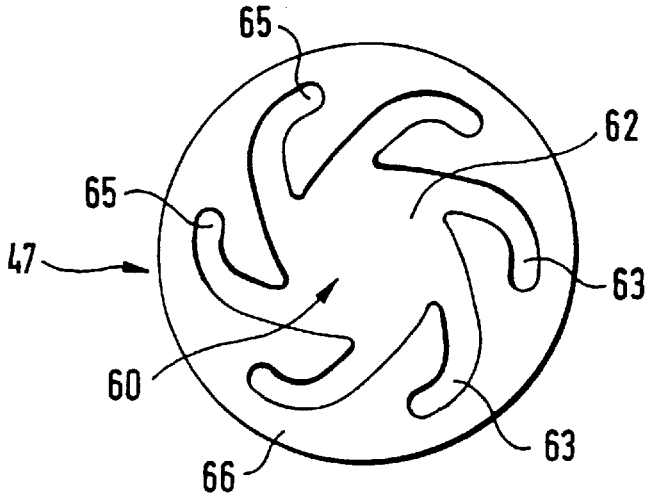
FIG. 3 shows a swirl element according to the present invention.

FIG. 3 shows a top view of a swirl element 47 embedded between guide element 35 and valve seat element 26 in the form of a single component which is positioned in passage 24 with as little clearance as possible around its circumference. Swirl element 47 can be economically produced from sheet metal, for example by punching, wire EDM, laser cutting, etching, or another known method or by electroplating. An inner opening area 60, which runs across the entire axial thickness of swirl element 47, is provided in swirl element 47. Opening area 60 is formed by an inner swirl chamber 62, through which valve closing segment 28 of valve needle 20 extends, and by a plurality of swirl channels 63 opening into swirl chamber 62. Swirl channels 63 open tangentially into swirl chamber 62 and are not attached to the outer circumference of swirl element 47 by their ends 65 facing away from swirl chamber 62. Instead, a circumferential rim area 66 remains between ends 65 of swirl channels 63 and the outer circumference of swirl element 47.

After valve needle 20 is mounted, swirl chamber 62 is limited to the inside by valve needle 20 (valve closing segment 28) and to the outside by the wall of opening area 60 of swirl element 47. Because swirl channels 63 open tangentially into swirl chamber 62, an angular momentum is imparted to the fuel and remains while the fuel continues to flow into discharge opening 32. Due to centrifugal force, the fuel is sprayed in the shape of a hollow cone. Swirl channels 63 can be lengthened, if desired, by curving or bending them. Hook-like bent ends 65 of swirl channels 63 act as collecting pockets which form a large-surface reservoir, allowing the fuel to flow in with little turbulence. After the flow has been diverted, the fuel enters actual tangential swirl channels 63 slowly and with low turbulence, making it possible to produce a largely disturbance-free swirl.

Figure 4:
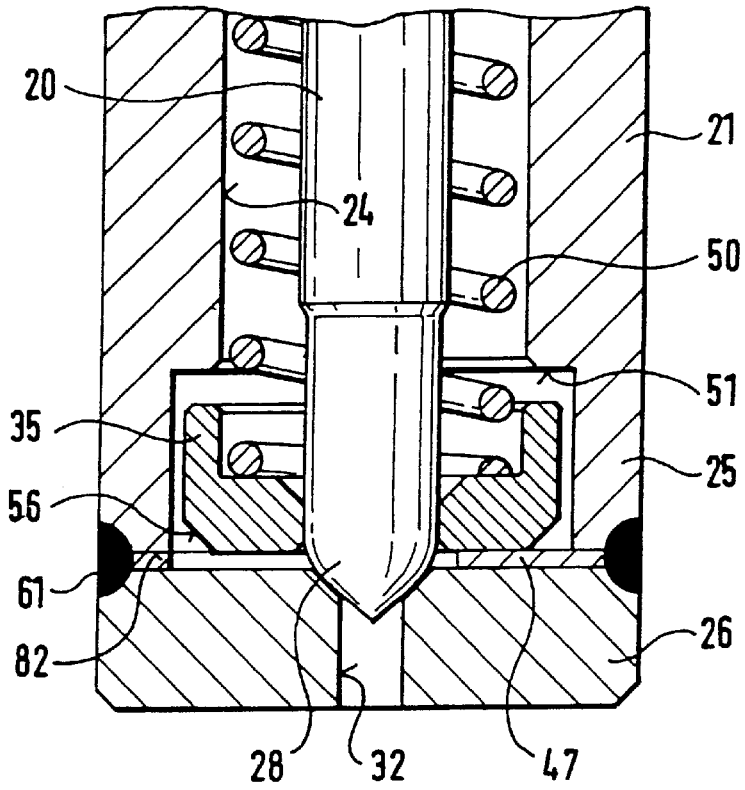
FIG. 4 shows a second guide and seating area according to the present invention.

In the further embodiments shown in the subsequent figures, the parts that remain the same or perform the same functions as in the embodiment illustrated in FIGS. 1 and 2 are identified by the same reference numbers. The main difference between the guide and seating area shown in FIG. 4 and the one in FIG. 2 is that a different method is provided for attaching valve seat element 26 to valve seat carrier 21. Since end 25 of valve seat carrier 21 is designed to be shorter downstream from step 51, only one of the three elements 35, 47, and 26, namely guide element 35, is accommodated in passage 24 in valve seat carrier 21. On the other hand, end face 82 of swirl element 47 rests against lower end 25 of valve seat carrier 21. Swirl element 47, which is designed with a larger outer diameter, can advantageously have longer swirl channels 63, thus reducing flow turbulence even further. Valve seat element 26 also has such an enlarged outer diameter, matching the outer diameter of swirl element 47. Valve seat element 26 is attached to valve seat carrier 21, for example, by a circumferential welded seam 61 on the outer circumference of valve seat element 26; welded seam 61 can be provided in the area of swirl element 47 so that swirl element 47 is welded directly to valve seat carrier 21 outside its swirl channels 63.

Figure 5:
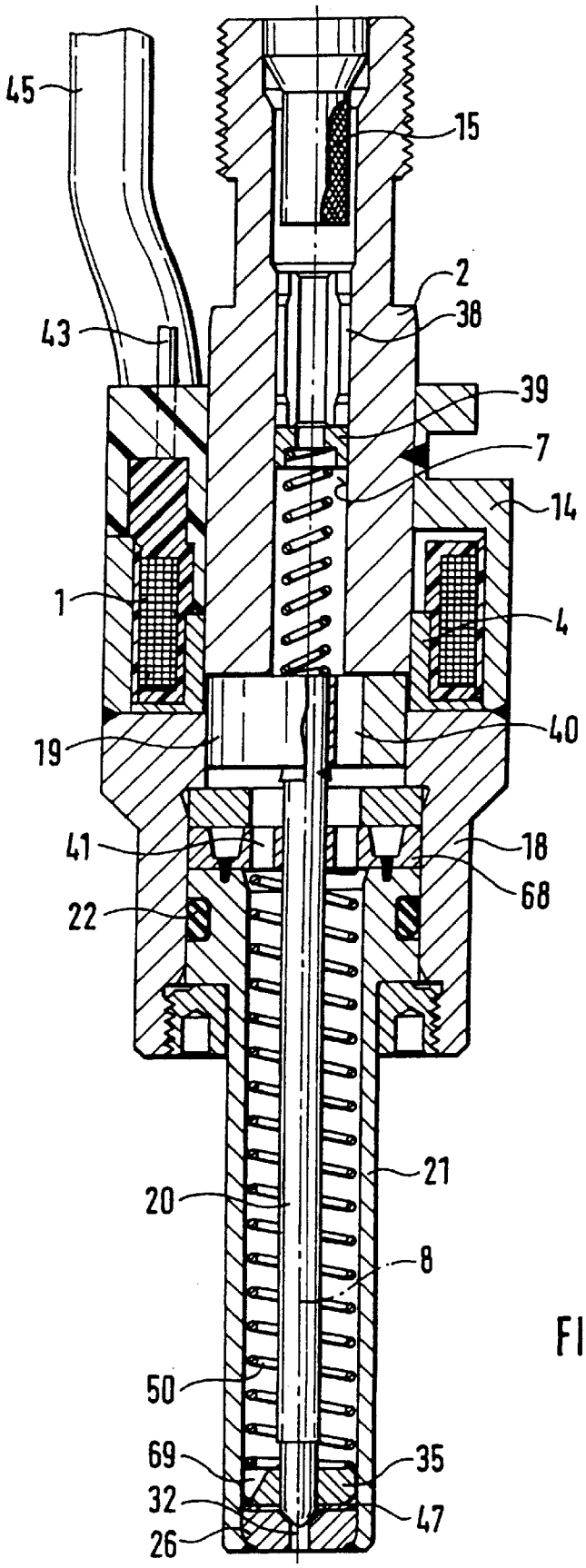
FIG. 5 shows a second embodiment of a fuel injection valve according to the present invention.

In the embodiment of a fuel injection valve illustrated in FIG. 5, valve seat carrier 21 is designed with much thinner walls than in the embodiment shown in FIG. 1. While the lower end of compression spring 50 is supported on the upper end face of guide element 35, which has no recess 52, the opposite end of compression spring 50 rests against a supporting plate 68. Supporting plate 68 is permanently attached to the upper end of valve seat carrier 21 by a welded seam. Instead of connecting channels 41 in valve seat carrier 21, supporting plate 68 in this embodiment has multiple connecting through passages 41 running in an axial direction. To improve fuel flow, at least one groove-like flow channel 69, which is shown more clearly in FIG. 6, is provided on the outer circumference of guide element 35.

Figure 6:
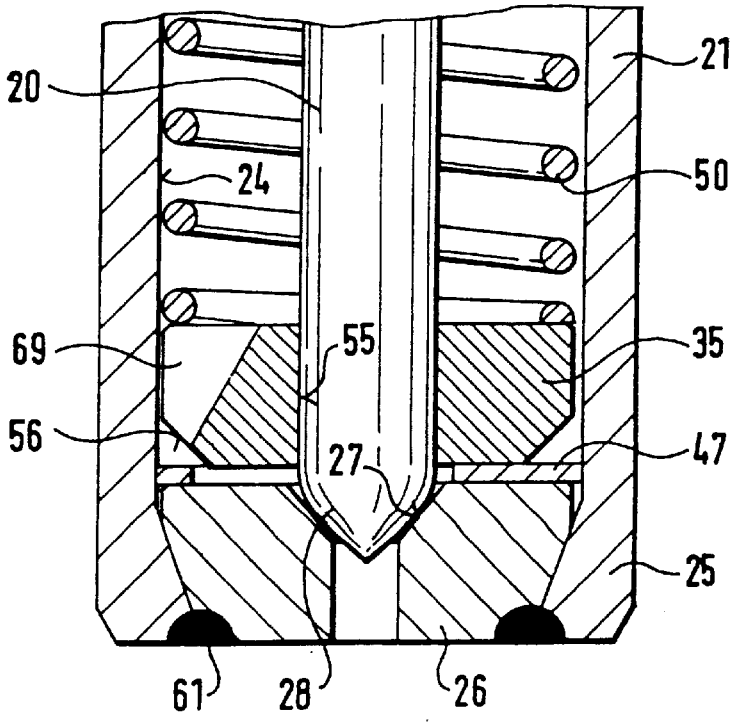
FIG. 6 shows an enlarged view of a third guide and seating area extracted from FIG. 5.

FIG. 6 shows the guide and seating area as a detail from FIG. 5 on a different scale in order to more clearly illustrate this valve area designed according to the present invention. The guide and seating area provided in passage 24 at injection end 25 of valve seat carrier 21 is again formed by three disc-shaped, functionally separate elements 35, 47, and 26 arranged consecutively in an axial direction. At lower end 25 of valve seat carrier 21, inner passage 24 is conically tapered in the direction of flow. Similarly, valve seat element 26 also has a conically tapered outer contour so that it will fit precisely inside valve seat carrier 21. In this embodiment, the three elements 35, 47, and 26 are inserted through passage 24 from above, i.e., from the side facing armature 19, starting with valve seat element 26. In this case, welded seam 61 at lower end 25 of valve seat carrier 21 is subjected to much less strain. Swirl element 47 has an outer diameter that allows it to fit inside passage 24 in valve seat carrier 21 with a small amount of clearance.

Figure 7:
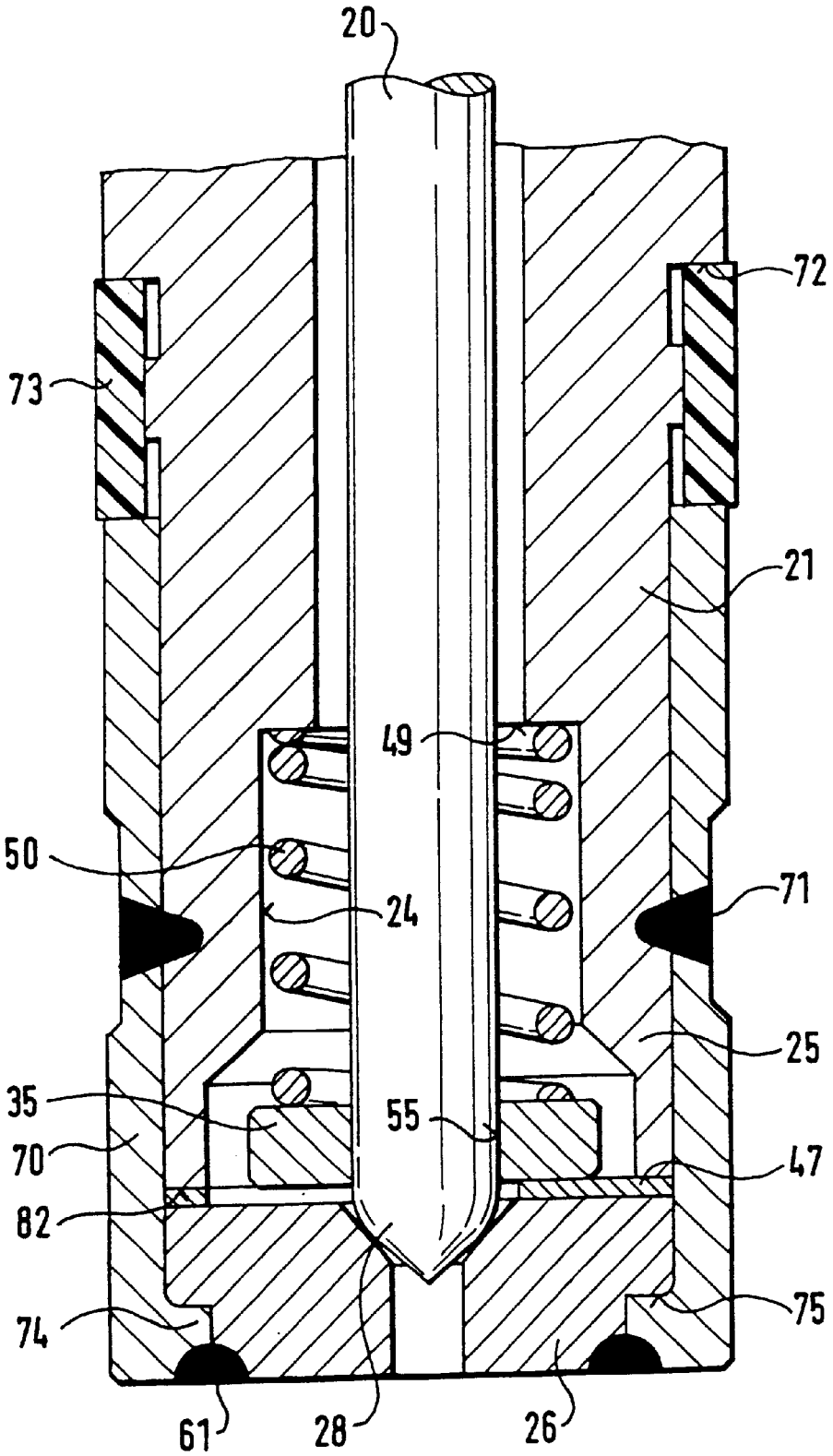
FIG. 7 shows a fourth guide and seating area according to the present invention.

FIG. 7 shows a further guide and seating area in which end 25 of valve seat carrier 21 is circumferentially surrounded by an additional tubular fastening element 70. Like the embodiment shown in FIG. 4, swirl element 47 and valve seat element 26 are provided with an outer diameter that is larger than the diameter of passage 24, so that end face 82 of swirl element 47 lies against end 25 of valve seat carrier 21. Guide element 35 is designed in the form of a flat disc and positioned inside passage 24, with its outer diameter being much smaller than the diameter of passage 24 so that fuel can flow in an axial direction along the outer circumference of guide element 35.

Valve seat element 26 and valve seat carrier 21 are permanently joined together by additional fastening element 70. Thin-walled, tubular fastening element 70 thus surrounds both valve seat element 26 and swirl element 47 as well as end 25 of valve seat carrier 21. Valve seat element 26 and fastening element 70 are joined together by welded seam 61 at their lower, abutting end faces. In a particularly advantageous manner, fastening element 70 has on its lower end face an inward projecting, circumferential shoulder 74 on which one step 75 of valve seat element 26 can be positioned. Based on this embodiment of fastening element 70, welded seam 61 can be created with the application of less material and with less welding delay. In an embodiment of this type, welded seam 61 is subjected to much less strain that in the embodiment shown in FIG. 2. Welding can therefore be carried out with less thermal energy, thus always guaranteeing the dimensional accuracy of valve seat element 26.

Valve seat carrier 21 and fastening element 70 are joined together by a second welded seam 71 that is, for example, slightly thicker than welded seam 61 and is provided, for example, upstream from guide element 35 starting at the outer circumference of fastening element 70. Additional fastening element 70 allows swirl element 47 and guide element 35 to be aligned very accurately with the longitudinal axis of valve seat carrier 21, thus preventing guide element 35 from becoming jammed or wedged on valve needle 20. Swirl element 47 has an outer diameter dimensioned so that it can fit tightly into fastening element 70. Compression spring 50, whose one end rests against spring-loaded guide element 35, while its end facing away from guide element 35 is supported on shoulder 49 of valve seat carrier 21, is again provided in passage 24 of valve seat carrier 21. A sealing element 73, for example, is inserted between an outer shoulder 72 of valve seat carrier 21 and the upper end of fastening element 70 facing away from welded seam 61.

As mentioned above, instead of designing valve closing segment 28 with a conically tapered profile, it can also have a different shape, such as a spherical one. If a spherical segment of this type is provided at the downstream end of valve needle 20, the center of the sphere is advantageously positioned at the axial height of guide element 35. This effectively prevents valve needle 20 from becoming jammed in guide element 35.

Figure 8:
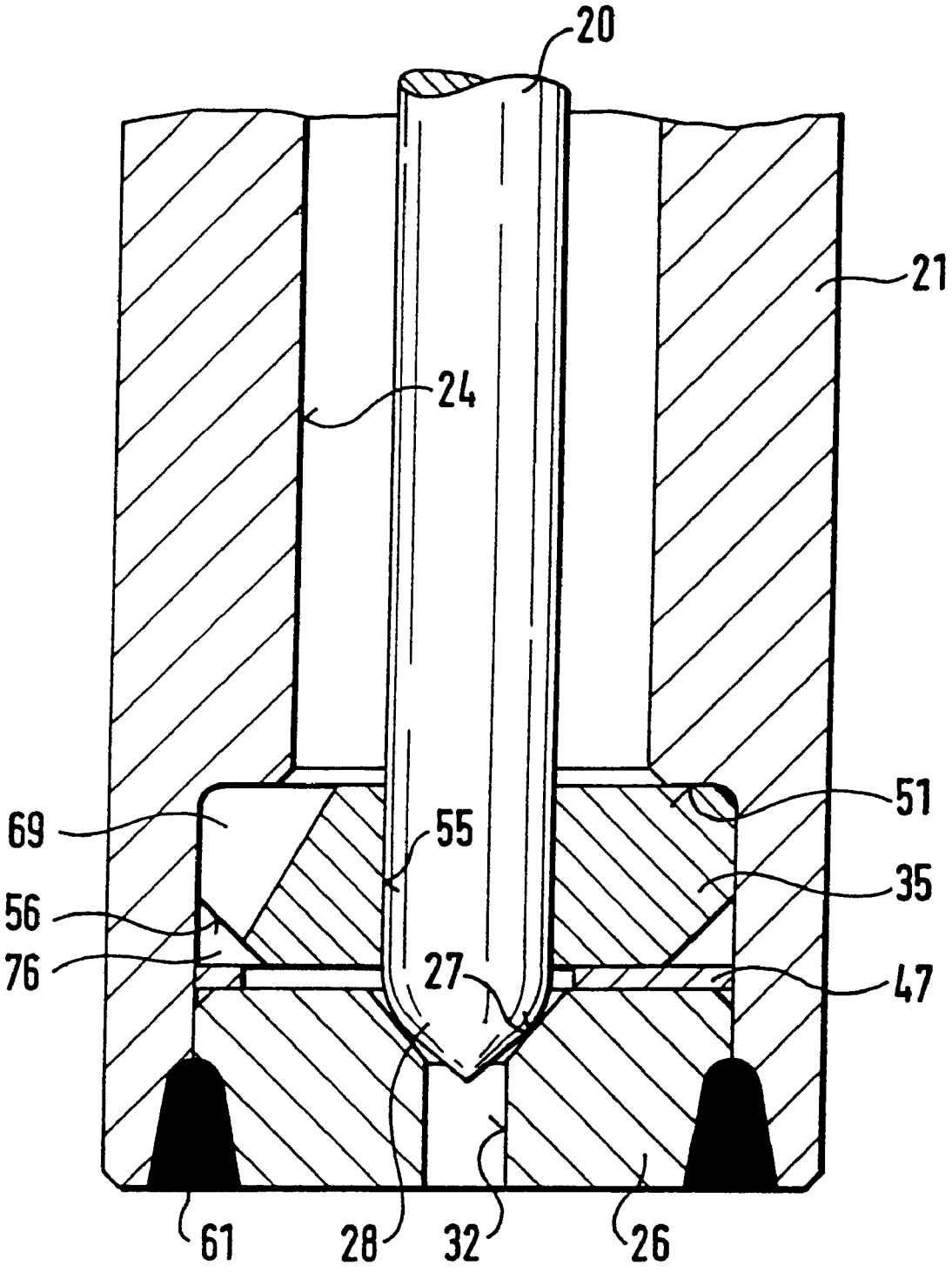
FIG. 8 shows a fifth guide and seating area according to the present invention.

FIG. 8 shows one embodiment, in which no compression spring 50 acting upon guide element 35 is provided. Step 51 provided in passage 24 is used in this case not only to increase the opening diameter so that it can hold elements 35, 47, and 26 but also as a contact surface for the upper end face of guide element 35. To ensure that fuel can flow in the direction of valve seat surface 27, at least one groove-like flow channel 69 is provided on the outer circumference of guide element 35. These flow channels 69 extend so far in a radial direction on the upper end face of guide element 35 that fuel can enter step 51 unhindered from a point upstream from the latter.

After flowing through at the least one flow channel 69, the fuel enters annular space 76 located between guide element 35 and swirl element 47, which is formed by the circumferential chamfer 56 molded onto the lower end face of guide element 35. The fuel flows out of annular space 76 into opening area 60, in particular into ends 65 of swirl channels 63 of swirl element 47 serving as collecting pockets. In the manner explained above, any disturbing turbulence present in the fluid is dissipated in collecting pockets 65.

In all embodiments, the clearance between valve needle 20 and guide element 35 in guide opening 55 is so small that the fuel flow cannot leak in this area due to the pressure difference between the two end faces of guide element 35. In the embodiment shown in FIG. 8, the three elements 35, 47, and 26 are premounted in passage 24. Guide element 35 has a much larger amount of clearance in passage 24 than does valve needle 20 in guide opening 55. This makes it possible to finally align guide element 35 with valve seat element 26, performing the alignment with the aid of valve needle 20 or an auxiliary body having a comparable contour. After elements 35, 47, and 26 have been aligned, they are pressed against step 51 of valve seat carrier 21 in the axial direction, and the downstream end face of valve seat element 26 is welded to valve seat carrier 21, maintaining the same tension (welded seam 61).

The embodiment shown in FIG. 8 can be designed so that elements 35, 47, and 26 are fixed in place with little clearance or even pressed into passage 24. In addition, valve seat element 26 can be mounted in passage 24 by welded seam 61 or by flanging.

Figure 9:
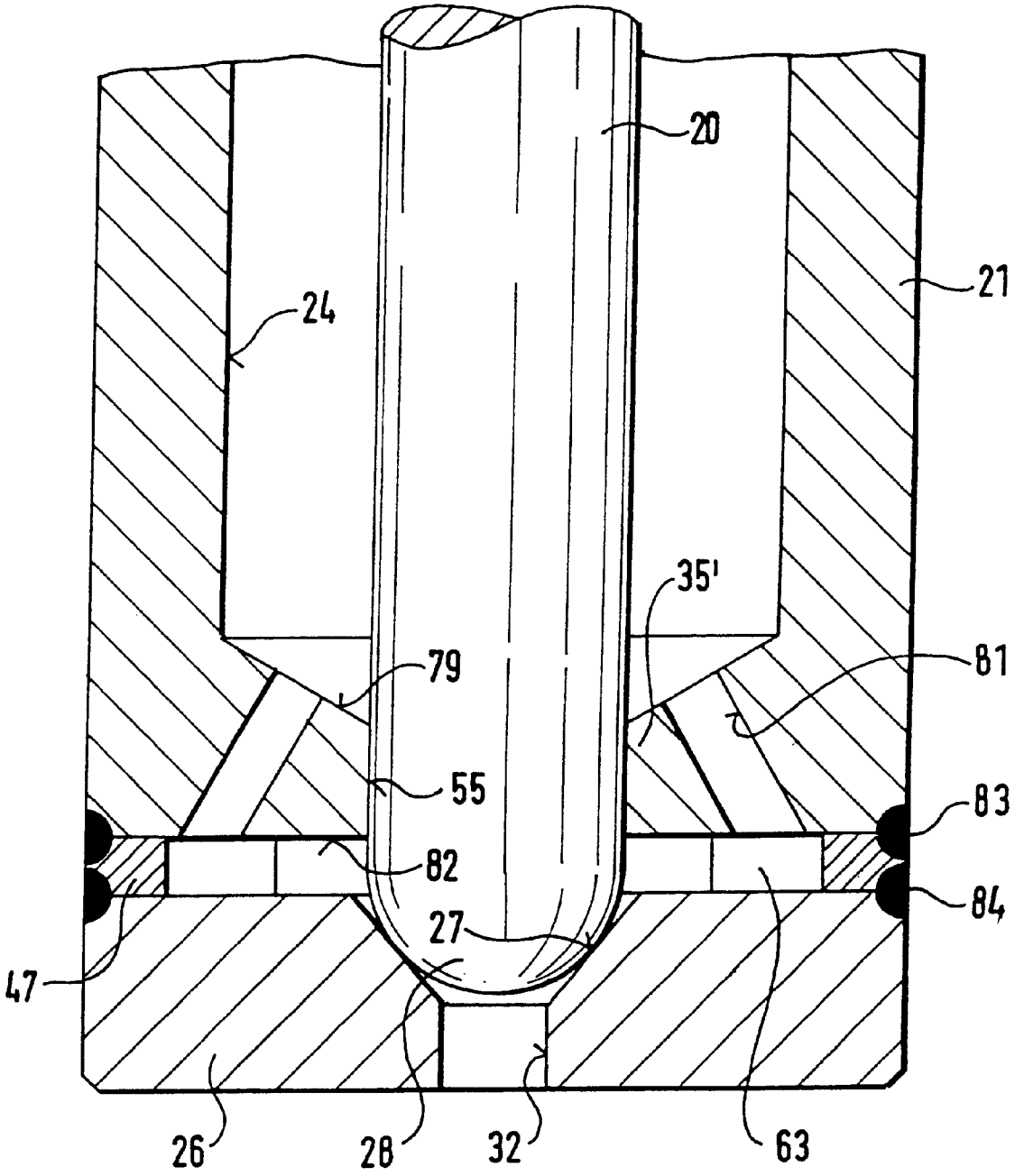
FIG. 9 shows a sixth guide and seating area according to the present invention.

FIG. 9 shows a further guide and seating area of a fuel injection valve according to the present invention in which no separate guide element is provided. Instead, valve seat carrier 21, which forms part of the valve housing, has a lower guide segment 35' facing valve seat element 26. Guide opening 55 for guiding valve needle 20 is thus integrated into valve seat carrier 21. Passage 24 in valve seat carrier 21 thus merges with guide opening 55 in the downstream direction. Upstream from guide opening 24, one or more flow openings 81, which run, for example, at an angle to longitudinal valve axis 8, and end at lower injection-side end face 82 of valve seat carrier 21, branch out of passage 24 in an opening segment 75 that tapers in the downstream direction.

Emerging from these flow openings 81, the fuel flows directly into swirl channels 63 of swirl element 47, which follows directly in the downstream direction. Swirl element 47 and valve seat surface 27 of valve seat element 26 are consecutively attached, forming a seal, to injection-side end face 82 of valve seat carrier 21, using two annular welded seams 83 and 84 provided on the outer circumference. For this purpose, valve seat carrier 21 as well as swirl element 47 and valve seat element 26 have, for example, the same outer diameter.

What is claimed is:

1. A fuel injection valve for a fuel injection system of an internal combustion engine and for directly injecting a fuel into a combustion chamber of the internal combustion engine, comprising:

an electromagnetic circuit;

a valve seat element;

a stationary valve seat provided on the valve seat element;

a valve needle arranged with respect to the electromagnetic circuit and being axially movable along a longitudinal valve axis, the valve needle including a valve closing segment that cooperates with the stationary valve seat to open and close the fuel injection valve;

a disk-shaped swirl element located directly upstream from the valve seat element, the disk-shaped swirl element including a circumferential rim area and an inner opening area, the inner opening area being provided with a plurality of swirl channels extending completely over an entire axial thickness of the disk-shaped swirl element, each one of the plurality of swirl channels being separated from an outer circumference of the disk-shaped swirl element by the circumferential rim area; and a separate guide element including an inner guide opening and provided directly upstream from the disk-shaped swirl element, wherein the separate guide element guides the valve needle through the inner guide opening and wherein the separate guide element is movable in a radial direction relative to the stationary valve seat.

2. The fuel injection valve according to claim 1, wherein the inner opening area of the disk-shaped swirl element is formed by a punching operation.

3. The fuel injection valve according to claim 1, wherein the inner opening area of the disk-shaped swirl element includes:

an inner swirl chamber, and the plurality of swirl channels opening into the inner swirl chamber.

4. The fuel injection valve according to claim 3, wherein each one of the plurality of swirl channels opens tangentially into the inner swirl chamber.

5. The fuel injection valve according to claim 3, wherein each one of the plurality of swirl channels includes a hook-shaped, bent end arranged at a distance from the inner swirl chamber.

6. The fuel injection valve according to claim 3, wherein the valve needle is movable along the longitudinal valve axis within the inner swirl chamber.

7. The fuel injection valve according to claim 1, further comprising:

a compression spring, wherein the separate guide element is pressed against the disk-shaped swirl element and indirectly against the valve seat element by the compression spring.

8. The fuel injection valve according to claim 7, wherein:

the separate guide element is disk-shaped, and the separate guide element includes a recess having a bottom on which the compression spring is supported.

9. The fuel injection valve according to claim 1, wherein the separate guide element includes at least one groove-like flow-channel provided on an outer circumference of the separate guide element.

10. The fuel injection valve according to claim 1, further comprising:

a housing; and a valve seat carrier coupled to the housing, wherein:

one end face of the separate guide element rests against the disk-shaped swirl element, and an opposite end face of the separate guide element rests against one step of the valve seat carrier in order to axially fasten the separate guide element in the housing.

11. The fuel injection valve according to claim 10, wherein the separate guide element, the disk-shaped swirl element, and the valve seat element are secured in place in the valve seat carrier according to an arrangement provided with little clearance.

12. The fuel injection valve according to claim 1, further comprising:

a valve seat carrier including a passage, wherein the disk-shaped swirl element, the valve seat element, and the separate guide element are arranged in the passage of the valve seat carrier and are completely surrounded in a circumferential direction by the valve seat carrier.

13. The fuel injection valve according to claim 1, further comprising:

a valve seat carrier including an inner passage, wherein:

the disk-shaped swirl element rests against a lower injection-side end face of the valve seat carrier, and the disk-shaped swirl element has an outer diameter that is larger than a diameter of the inner passage of the valve seat carrier.

14. The fuel injection valve according to claim 13, further comprising:

a tubular fastening element attached to the valve seat carrier and the valve seat element by welded seams, the tubular fastening element being located on an outer circumference of a downstream end of the valve seat carrier.

15. A fuel injection valve for a fuel injection system of an internal combustion engine and for directly injecting a fuel into a combustion chamber of the internal combustion engine, comprising:

an electromagnetic circuit;

a valve seat element;

a stationary valve seat provided on the valve seat element;

a valve needle arranged with respect to the electromagnetic circuit and being axially movable along a longitudinal valve axis, the valve needle including a valve closing segment that cooperates with the stationary valve seat to open and close the fuel injection valve;

a disk-shaped swirl element located directly upstream from the valve seat element, the disk-shaped swirl element including a circumferential rim area and an inner opening area, the inner opening area being provided with a plurality of swirl channels extending completely over an entire axial thickness of the disk-shaped swirl element, each one of the plurality of swirl channels being separated from an outer circumference of the disk-shaped swirl element by the circumferential rim area; and a valve seat carrier including a guide segment and an inner guide opening for guiding the valve needle, wherein the guide segment is located directly upstream from the disk-shaped swirl element.

* * * * *